United States Patent [19]

Onishi

[11] 4,204,488

[45] May 27, 1980

[54] 2-CYCLE ENGINE OF AN ACTIVE THERMOATMOSPHERE COMBUSTION TYPE

[75] Inventor: Sigeru Onishi, Kanazawa, Japan

[73] Assignee: Toyota Jidosha Kogyo Kabushiki Kaisha, Aichi, Japan; a part interest

[21] Appl. No.: 970,173

[22] Filed: Dec. 18, 1978

[30] Foreign Application Priority Data

Dec. 21, 1977 [JP] Japan ..... 52/152947

[51] Int. Cl.[2] ..... F02B 33/04

[52] U.S. Cl. ..... 123/73 A; 123/73 R; 123/73 PP; 123/73 SP

[58] Field of Search ..... 123/73 A, 73 R, 73 SP, 123/73 PP

[56] References Cited

U.S. PATENT DOCUMENTS 2,058,526 10/1936 Tanner ..... 123/73 A

*Primary Examiner*—Wendell E. Burns

*Attorney, Agent, or Firm*—Stevens, Davis, Miller & Mosher

[57] ABSTRACT

A 2-cycle engine having a transfer passage communicating the crank case with the combustion chamber. The transfer passage comprises a first passage and a second passage. The first passage has a long length and a small cross-sectional area for causing a fresh combustible mixture to flow at a high speed. The second passage has a short length and a large cross-sectional area for causing a fresh combustible mixture to flow at a low speed. The second passage is connected to the crank room via the bypass passage. A normally closed valve is arranged in the bypass passage. The valve is opened when the engine is operating under a heavy load.

23 Claims, 12 Drawing Figures

2-CYCLE ENGINE OF AN ACTIVE THERMOATMOSPHERE COMBUSTION TYPE

DESCRIPTION OF THE INVENTION

The present invention relates to a 2-cycle engine of an active thermoatmosphere combustion type.

As a 2 cycle engine capable of considerably reducing the fuel consumption and the amount of harmful components in the exhaust gas, and also, capable of obtaining the quiet operation of the engine, the inventor has already proposed an active thermoatmosphere combustion type 2-cycle engine. In this 2-cycle engine, the transfer passage communicating the combustion chamber with the crank room of the engine comprises a long first passage having a small sectional area and connected to the crank room, and a short second passage having a cross sectional area which is larger than that of the first passage. This second passage is connected to the first passage on the one hand and to the inlet port opening into the combustion chamber on the other hand. In this 2-cycle engine, the fresh combustible mixture forced into the first passage from the crank room is caused to flow at a high speed in the first passage and, as a result, the vaporization of the liquid fuel is promoted in the first passage. The high speed stream of the fresh combustible mixture flowing in the first passage is decelerated in the second passage and, then, the fresh combustible mixture stream thus decelerated is caused to flow at a low speed into the combustion chamber. As a result of this, an active thermoatmosphere is created in the combustion chamber. Then, the active thermoatmosphere continues to be maintained during the compression stroke, and self-ignition of the fresh combustible mixture is caused at the end of the compression stroke.

In such a 2-cycle engine, proposed by the inventor, as mentioned above, in order to promote the vaporization of the fresh combustible mixture by causing the fresh combustible mixture to flow at a high speed, a part of the transfer passage, that is, the first passage is so formed that it has a small cross-sectional area. Consequently, the fresh combustible mixture flowing in the transfer passage is subjected to a flow resistance when the fresh combustible mixture flows in the first passage. As a result of this, it is impossible to feed the fresh combustible mixture into the combustion chamber in an amount which is sufficient to obtain a high output torque, even if the throttle valve of the carburetor is fully opened. Thus, it is difficult to obtain a high output torque when the engine is operating under a heavy load. The occurrence of this difficulty is natural because the above-mentioned 2-cycle engine is so constructed that it is suitable for operation under a partial load for a long time. However, a higher output torque may be required when a 2-cycle engine is operating under a heavy load in the case wherein a 2-cycle engine is used for another purpose. In order to obtain a high output torque when an engine is operating under a heavy load, it is necessary to feed a large amount of the fresh combustible mixture into the combustion chamber. In this case, since the fresh combustible mixture is caused to flow at a high speed into the combustion chamber, the turbulence and the movement of the residual burned gas in the combustion chamber is caused and, as a result, it is difficult to cause a complete active thermoatmosphere combustion. However, in this case, since the vaporization of the liquid fuel contained in the fresh combustible mixture fed into the combustion chamber is considerably promoted, a high output torque can be obtained while reducing the fuel consumption and the amount of harmful components in the exhaust gas as compared with those in a conventional 2-cycle engine.

An object of the present invention is to provide an active thermoatmosphere combustion type 2-cycle engine capable of obtaining a high output torque and also capable of reducing the fuel consumption and the amount of harmful components in the exhaust gas independent of the level of load of an engine.

According to the present invention, there is provided a 2-cycle engine comprising: an engine body having therein a cylinder bore and a crank room which has a bottom wall; a piston reciprocally movable in said cylinder bore, said piston and said cylinder bore defining a combustion chamber; an intake passage having mixture forming means therein for introducing a fresh combustible mixture into said crank room; an exhaust passage having an exhaust port opening into said combustion chamber for discharging exhaust gas into the atmosphere; first transfer passage means having an inlet opening which opens into said crank room; second transfer passage means communicating said first transfer passage means with an inlet port opening into said combustion chamber, said second transfer passage means having a cross-sectional area which is larger that of said first transfer passage means; bypass passage means communicating said second transfer passage means with said crank room; normally closed valve means arranged in said bypass passage means and actuated in response to changes in the level of the load of the engine for opening said valve means when the load of the engine is increased beyond a predetermined level, and; ignition means arranged in said combustion chamber.

The present invention may be more fully understood from the description of preferred embodiments of the invention set forth below, together with the accompanying drawings.

DESCRIPTION OF PREFERRED EMBODIMENTS

Figure 1:
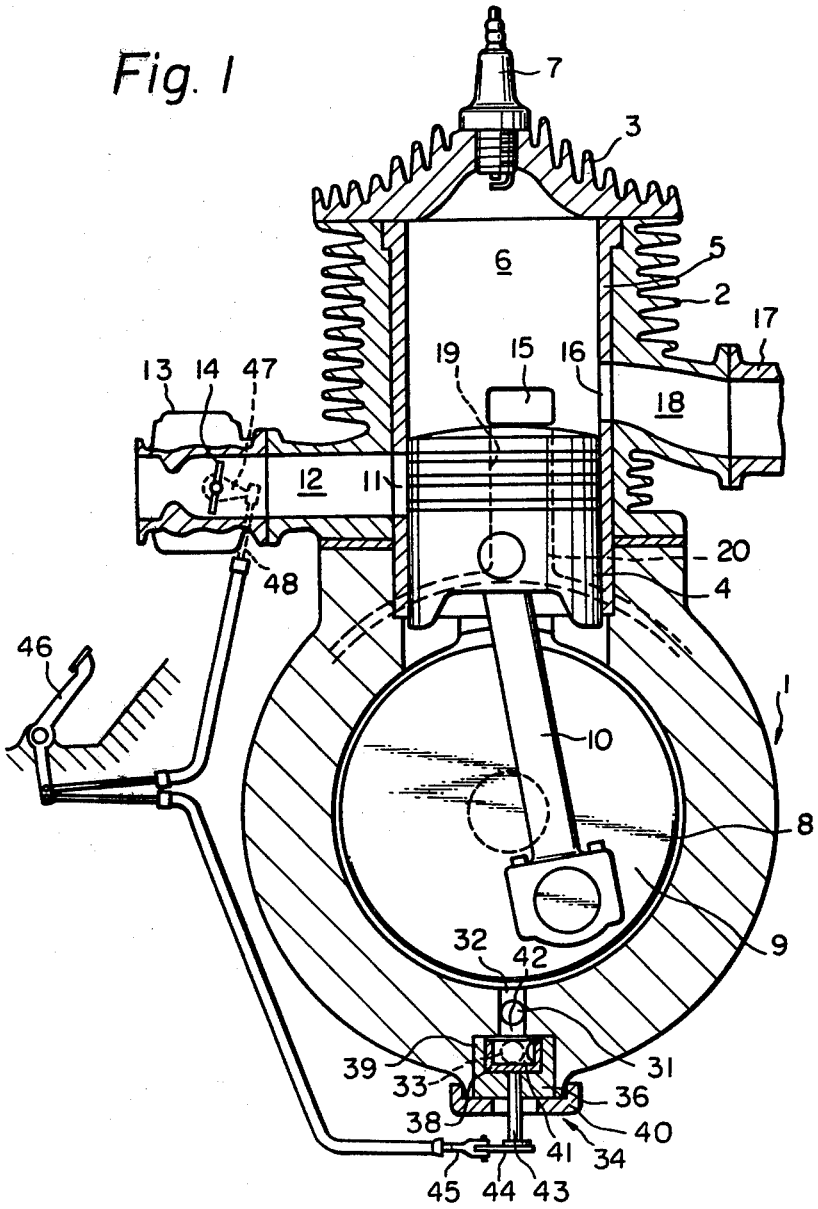
FIG. 1 is a cross-sectional side view of an embodiment of a 2-cycle engine according to the present invention.
Figure 2:
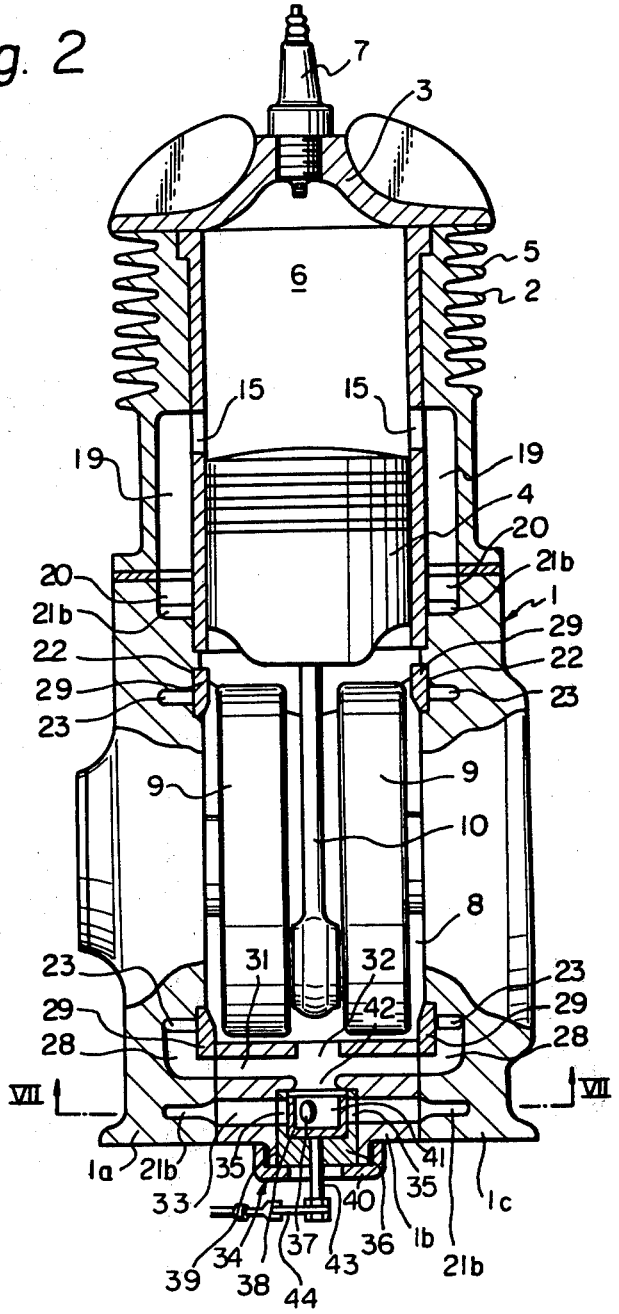
FIG. 2 is a cross-sectional side view of the engine shown in FIG. 1.
Figure 5:
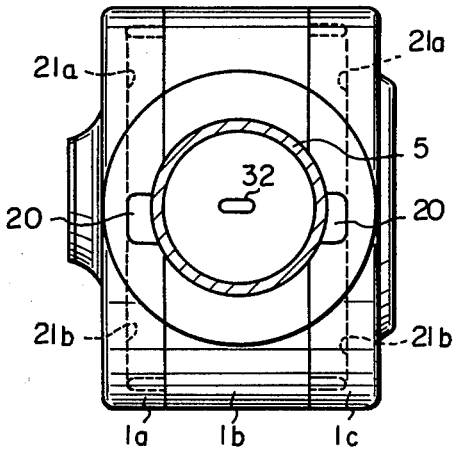
FIG. 5 is a plan view of a crank case.
Figure 6:
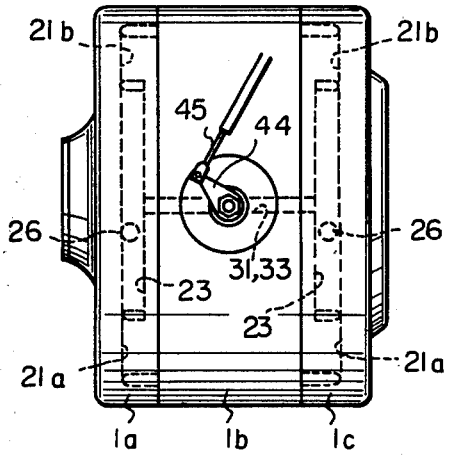
FIG. 6 is a bottom view of a crank case.

Referring to FIGS. 1 and 2, 1 designates a crank case, 2 a cylinder block fixed onto the crank case, 3 a cylinder head fixed onto the cylinder block 2, 4 a piston having an approximately flat top face and reciprocally moving in a cylinder liner 5 fitted into the cylinder block 2 and 6 a combustion chamber formed between the cylinder head 3 and the piston 4; 7 designates a spark plug, arranged on the apex of the combustion chamber 6; 8 designates a crank room formed in the crank case 1 and 9 a balance weight; 10 designates a connecting rod, 11 an intake port formed in the cylinder liner 5; 12 designates an intake passage and 13 a carburetor; 14 designates a throttle valve of the carburetor 13, 15 a pair of inlet ports formed in the cylinder liner 5; 16 designates an exhaust port formed in the cylinder liner 5; 17 designates an exhaust pipe, and 18 an exhaust passage. The embodiment illustrated in FIGS. 1 and 2 has a Schnurle type 2-cycle engine having an effective compression ratio of 6.5:1. As illustrated in FIGS. 2, 5 and 6, the crank case 1 comprises three crank case parts 1*a*, 1*b* and 1*c*. A pair of transfer passages 19, each of which opens into the combustion chamber 6 at the inlet port 15 and vertically extends along the outer wall of the cylinder liner 5, is formed in the cylinder block 2, and the transfer passages 19 are connected to corresponding transfer passages 20, each of which is formed on the upper portion of the crank case 1 and aligned with the respective transfer passage 19. The transfer passage consisting of the transfer passages 20 and 21 is hereinafter referred to as a second transfer passage.

Figure 3:
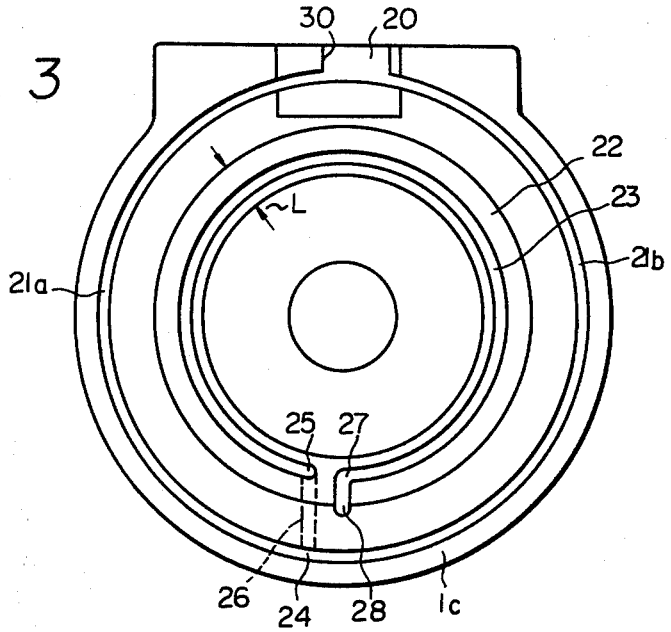
FIG. 3 is a front view of the crank case part 1*c;*
Figure 4:
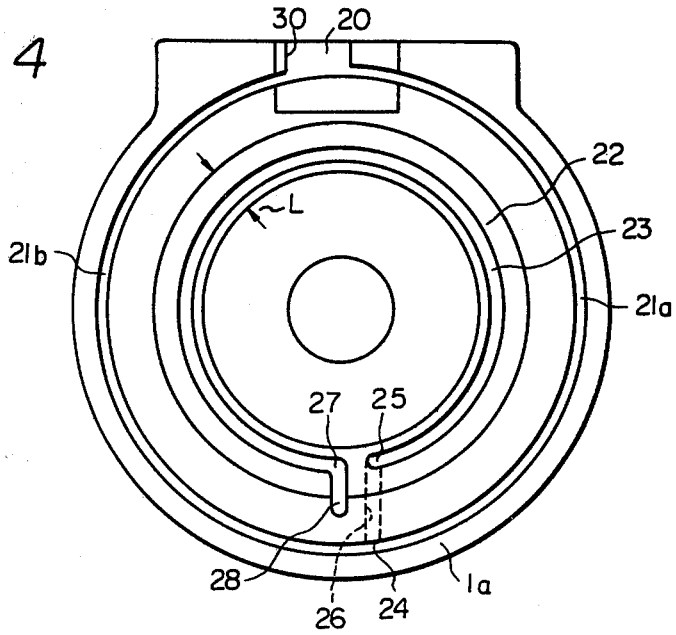
FIG. 4 is a front view of the crank case part 1*a;*

FIG. 3 illustrates the inner wall of the crank case part 1*c*, and FIG. 4 illustrates the inner wall of the crank case part 1*a*. Referring to FIGS. 3 and 4, a pair of grooves 21*a* and 21*b* is formed on the inner wall of the crank case part 1*a*, 1*c* and arranged to extend along the circular periphery thereof. A shallow annular groove 22, having a fixed width L, is formed on the inner wall of the crank case part 1*a*, 1*c* at a position located inward of the grooves 21*a* and 21*b*, and in addition, a groove 23 extending along the annular groove 22 is formed on the central portion of the bottom face of the annular groove 22. The grooves 21*a* and 21*b* are joined to each other at the lowest portion 24 thereof. One end 25 of the groove 23 is in communication with the lowest portion 24 of the grooves 21*a* and 21*b* via a hole 26 formed in the crank case part 1*a*, 1*c*, while the other end 27 of the groove 23 is connected to a short vertical groove 28 extending downwardly. As is illustrated in FIG. 2, annular plates 29 are fitted into the annular grooves 22 and urged onto the crank case parts 1*a*, 1*c* by the crank case part 1*b* when the crank case parts 1*a*, 1*b* and 1*c* are assembled to form the crank case 1, as illustrated in FIG. 2. Consequently, from FIGS. 2, 3 and 4, it will be understood that, when the crank case parts 1*a*, 1*b* and 1*c* are assembled to form the crank case 1, each of the grooves 21*a*, 21*b*, 23 and 28 forms a passage. In addition, from FIGS. 2 and 6, it will also be understood that the depth of the groove 21*a*, 21*b* is deeper than that of the groove 23. As is illustrated in FIGS. 3 and 4, a groove 30 defining the transfer passage 20 and having a depth which is approximately equal to that of the groove 21*a*, 21*b* is formed on the upper end portion of the inner wall of the crank case 1*a*, 1*c*, and each of the grooves 21*a* and 21*b* opens into the bottom of the groove 30. As is illustrated in FIGS. 1 and 2, a transverse hole 31 is formed in the lower end portion of the crank case part 1*b* and arranged to align with each of the vertical short grooves 28 which are formed on the inner walls of the respective crank case parts 1*a*, 1*c*. This transverse hole 31 is connected to the crank room 8 via a vertical hole 32 which is formed on the bottom wall of the crank room 8.

As will be understood from the above description, each of the transfer passages 20 is connected to the crank room 8 via the grooves 21*a*, 21*b*, the hole 26, the groove 23, 28 the transverse hole 31 and the vertical hole 32. The passage consisting of the grooves 21*a*, 21*b*, the hole 26, the groove 23, 28, the transverse hole 31 and the vertical hole 32 is hereinafter referred to as a first transfer passage. Consequently, it will be understood that the crank room 8 is connected to the combustion chamber 6 via the above-mentioned first transfer passage and the second transfer passage mentioned previously.

Referring to FIGS. 1, 2, 6 and 7, another transverse hole 33 is formed in the lower end portion of the crank case part 1*b* and arranged beneath the transverse hole 31 so as to interconnect the grooves 21*b* to each other, which grooves are formed on the inner walls of the crank case parts 1*a* and 1*c*, respectively. A valve device generally designated by reference numeral 34 is arranged in the other transverse hole 33. This valve device 34 comprises a sleeve 36 forming a pair of openings 35 thereon, and a hollow cylindrical rotary valve 38 forming a pair of openings 37 thereof. The sleeve 36 is fitted into a recess 39 formed on the bottom outer surface of the crank case part 1*b*, and the sleeve 36 is secured onto the crank case part 1*b* by means of a nut 40, so that the openings 35 of the sleeve 36 are aligned with the transverse hole 33. A valve chamber 41 formed within the rotary valve 38 is always in communication with the crank room 8 via a vertical hole 42 and the vertical hole 32 which are aligned with each other. A control rod 43 is fixed onto the bottom wall of the rotary valve 38, and a lever 44 is fixed onto the lower end of the control rod 43. The tip of the lever 44 is connected to an accelerator pedal 46 via a wire 45 and, in addition, the tip of a lever 47 fixed onto the throttle valve 14 is also connected to the accelerator pedal 46 via a wire 48.

Figure 7:
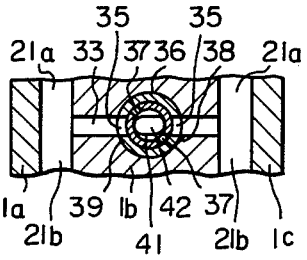
FIG. 7 is a cross-sectional view taken along the line VII—VII in FIG. 2.

FIG. 7 illustrates the case wherein the opening degree of the throttle valve 14 is small and, thus, the engine is operating under a light load. At this time, as is illustrated in FIG. 7, the openings 35 of the sleeve 36 are closed by the rotary valve 38 and, therefore, the crank room 8 is connected to the transfer passage 20 via the first transfer passage, that is, via the transverse hole 31, the grooves 28, 23, the hole 26 and the grooves 21*a*, 21*b*. When the accelerator pedal 46 is depressed, the throttle valve 14 and the rotary valve 38 are rotated, and then, the valve chamber 41 of the rotary valve 38 is connected to the transverse hole 33 via the openings 37, 35 when the opening degree of the throttle valve 14 becomes about 75 percent relative to the full open degree. Consequently, at this time, as is hereinafter described in detail, the fresh combustible mixture in the crank room 8 is fed into the transfer passage 20 via the vertical hole 32, 42, the openings 37, 35, the transverse hole 33 and the grooves 21*a*, 21*b*. That is, the transverse hole 33 forms a bypass passage used for feeding the fresh combustible mixture into the grooves 21*a*, 21*b* without passing through the groove 23 when the engine is operating under a heavy load.

In operation, when the engine is operating under a partial load, that is, when the openings 35 of the sleeve 36 is closed by the rotary valve 38, the fresh combustible mixture introduced into the crank room 8 from the intake port 11 is gradually compressed in accordance with the downward movement of the piston 4 and, thus, the fresh combustible mixture is forced into the transverse hole 31 via the vertical hole 32. Then, the fresh combustible mixture flows into the grooves 21*a*, 21*b* via the vertical groove 28, the groove 23 and the hole 26. As will be understood from FIGS. 1 and 6, since the groove 23 has an extremely small cross-sectional area, the fresh combustible mixture flows at a high speed in the groove 23 and then flows into the grooves 21*a*, 21*b*. As is mentioned above, the fresh combustible mixture is caused to flow at a high speed in the groove 23, the flow energy is added to the fresh combustible mixture and, as a result, the vaporization of the liquid fuel continues to be promoted during this time. Then, the fresh combustible mixture flows into the grooves 21*a* and 21*b*. As will be understood from FIGS. 1 and 6, since the cross-sectional area of the groove 21*a*, 21*b* is larger than that of the passage 23 and, in addition, the fresh combustible mixture flowing out from the passage 23 is branched off into two streams, the flow velocity of the fresh combustible mixture flowing in the passages 21*a* and 21*b* is reduced, as compared with the case wherein the fresh combustible mixture flows in the passage 23. However, the flow velocity of the fresh combustible mixture flowing in the grooves 21*a* and 21*b* is relatively high and, thus, the liquid fuel which has not been vaporized in the groove 23 is sufficiently vaporized in the grooves 21*a* and 21*b*. After the vaporization of the fresh combustible mixture is sufficiently promoted, the fresh combustible mixture in the first transfer passage flows into the second transfer passage. At this time, since the streams of the fresh combustible mixture flowing out from the passages 21*a* and 21*b* come into violent contact with each other in the transfer passage 20 and lose kinetic energy, and in addition, the transfer passage 20 has a cross-sectional area which is considerably larger than those of the passages 21*a* and 21*b*, the fresh combustible mixture flowing into the transfer passage 20 from the passages 21*a* and 21*b* is abruptly decelerated. After this, the fresh combustible mixture moves upward at a low speed in the transfer passages 20 and 19, and then, flows into the combustion chamber 6 at a low speed when the piston 4 opens the inlet ports 15. Even if the pressure in the crank room 8 is considerably higher than that in the combustion chamber 6 when the piston 4 opens the inlet ports 15 to permit the inflow of the fresh combustible mixture into the combustion chamber 6, since the passage 23 functions as throttling means because it has a small cross-sectional area, the fresh combustible mixture can not flow into the combustion chamber 6 at a high speed. As a result of this, the flow velocity of the fresh combustible mixture is low throughout the inflow operation of the fresh combustible mixture. Consequently, when the fresh combustible mixture flows into the combustion chamber 6, the movement of the residual burned gas in the combustion chamber 6 is extremely small and, as a result, the dissipation of the heat of the residual burned gas is prevented. Thus, the residual burned gas is maintained at a high temperature. In addition, at the beginning of the compression stroke under a partial load of the engine, a large amount of the residual burned gas is present in the combustion chamber 6. Since the amount of the residual burned gas in the combustion chamber 6 is large and, in addition, the residual burned gas has a high temperature, the fresh combustible mixture is heated until radicals are produced and, as a result, an active thermoatmosphere is created in the combustion chamber 6. An atmosphere wherein radicals are produced as mentioned above is hereinafter called an active thermoatmosphere. Since the movement of the gas in the combustion chamber 6 is extremely small during the compression stroke, the occurrence of turbulence and the loss of heat energy escaping into the inner wall of the combustion chamber 6 are restricted to the smallest possible extent. Consequently, the temperature of the gas in the combustion chamber 6 is further increased as the compressing operation progresses and, as a result, the amount of radicals produced in the combustion chamber 6 is further increased. When the radicals are produced, the combustion which is called a preflame reaction has been started. After this, when the temperature of the gas in the combustion chamber 6 becomes high at the end of the compression stroke, a hot flame generates to cause the self ignition which is not caused by the spark plug 7. Then, the gentle combustion is advanced while being controlled by the residual burned gas. When the piston 4 moves downwards and opens the exhaust port 16, the burned gas in the combustion chamber 6 is discharged into the exhaust passage 18.

When the engine is operating under a heavy load, that is, when the throttle valve 14 is greatly opened, the crank room 8 is connected to the grooves 21*a*, 21*b* via the openings 37, 35 and the transverse hole 33, that is, via the bypass passage as mentioned previously. At this time, the grooves 21*a*, 21*b* are in communication with the crank room 8 via the groove 23 and the transverse hole 31. However, since the cross-sectional area of the groove 23 is extremely small, the flow resistance of the passage 23 is large and, as a result, a large part of the fresh combustible mixture flows into the grooves 21*a*, 21*b* from the crank room 8 via the vertical holes 32, 42, the valve chamber 41, the openings 37, 35 and the transverse hole 33. As mentioned previously, since the cross-sectional area of the grooves 21*a*, 21*b* is larger than that of the groove 23 and, in addition, the fresh combustible mixture is branched off to two streams which flow in the grooves 21*a* and 21*b*, respectively, the fresh combustible mixture flowing in the passages 21*a*, 21*b* is subjected to the flow resistance which is smaller than the case wherein the fresh combustible mixture flows in the groove 23. As a result of this, a large amount of the fresh combustible mixture flows at a relatively high speed in the grooves 21*a* and 21*b*. At this time, the flow energy is added to the fresh combustible mixture flowing in the grooves 21*a*, 21*b* and, thus, the vaporization of the liquid fuel is promoted. After this, the fresh combustible mixture moves upwards at a relatively high speed in the transfer passages 20, 19 and then flows into the combustion chamber 6. At this time, since the fresh combustible mixture flows into the combustion chamber 6 at a relatively high speed, the turbulence and the movement of the residual burned gas in the combustion chamber 6 is caused. As a result of this, a complete active thermoatmosphere combustion can not be carried out, and the fresh combustible mixture is ignited by the spark plug 7. However, even if the complete active thermoatmosphere combustion is not carried out, since the vaporization of the liquid fuel is considerably promoted and, in addition, the dissipation of the heat of the residual burned gas is reduced as compared with that in a conventional 2-cycle engine, specific fuel consumption is improved and, at the same time, the amount of harmful components in the exhaust gas is greatly reduced.

The fresh combustible mixture sucked into the crank room 8 from the intake port 11 when the piston 4 moves upwards contains a large amount of the liquid fuel. This liquid fuel is gathered on the bottom of the crank room 8, after it is sucked into the crank room 8. However, in the case wherein the open end of the first transfer passage opens into the bottom of the crank room 8, as in the present invention, since the liquid fuel gathered on the bottom of the crank room 8 is forced into the first transfer passage or the bypass passage together with the air-fuel mixture, it is possible to supply the combustion chamber 6 with the fuel in an amount which varies precisely in response to the load of the engine, that is, in the opening degree of the throttle valve 14.

In a conventional 2-cycle engine, in order to minimize the flow resistance to which the fresh combustible mixture is subjected when the engine is operating under a heavy load, the length of the scavenging passage is shortened in such a way that the scavenging passage opens into the upper interior of the crank room. However, a conventional engine has drawbacks in that, since a large amount of the liquid fuel contained in the introduced fresh combustible mixture is gathered on the bottom of the crank room when the engine is started, the fresh combustible mixture fed into the combustion chamber becomes excessively lean, whereby a long time is necessary to cause ignition of the fresh combustible mixture. In addition, a conventional engine has further drawbacks in that, since a great vacuum is produced in the crank room after ignition, the liquid fuel gathered on the bottom of the crank room is instantaneously vaporized and, as a result, an excessively rich mixture is fed into the combustion chamber, thus causing a misfire. However, in the present invention, the above-mentioned drawbacks are eliminated by arranging the first scavenging passage or the bypass passage so as to open into the bottom of the crank room.

Figure 8:
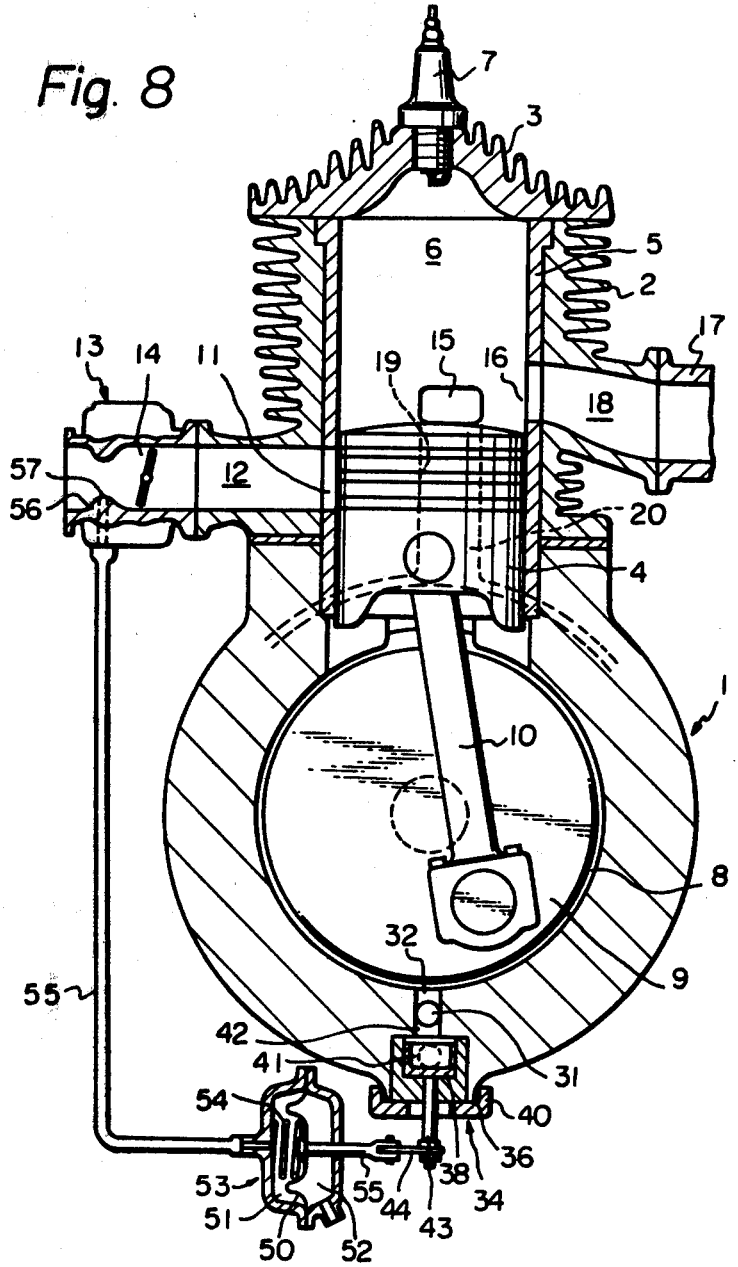
FIG. 8 is a cross-sectional side view of another embodiment according to the present invention.

FIG. 8 illustrates another embodiment according to the present invention. In FIG. 8, similar components are indicated with the same reference numerals as used in FIGS. 1 through 7. Referring to FIG. 8, a diaphragm apparatus 53 is provided, which comprises a vacuum chamber 51 and an atmospheric pressure chamber 52, which are separated by a diaphragm 50. A compression spring 54 is arranged in the vacuum chamber 51, so that the diaphragm 50 is always urged towards the right in FIG.8 due to the spring force of the compression spring 54. The tip of a control rod 55 fixed onto the diaphragm 50 is pivotally connected to the tip of the lever 44 of the control rod 43. The vacuum chamber 51 is connected via a vacuum conduit 55 to a vacuum port 57 which opens into a venturi 56 of the carburetor 13. The level of vacuum produced in the venturi 56 is increased as the amount of air introduced into the intake passage 12 from the atmosphere is increased. When the level of vacuum produced in the venturi 56 is increased beyond a predetermined level, since the diaphragm 50 moves towards the left in FIG. 8 against the spring force of the compression spring 54, the rotary valve 38 is rotated, and as a result, the valve chamber 41 of the rotary valve 38 is connected to the transverse hole 33 via the openings 37, 35. As will be understood from the above description, in this embodiment, when the amount of air introduced into the intake passage 12 from the atmosphere is small, the fresh combustible mixture in the crank room 8 is fed into the second transfer passage via the first transfer passage, while the fresh combustible mixture in the crank room 8 is fed into the second transfer passage via the bypass passage and the grooves 21*a*, 21*b* when the amount of the introduced air is large.

Figure 9:
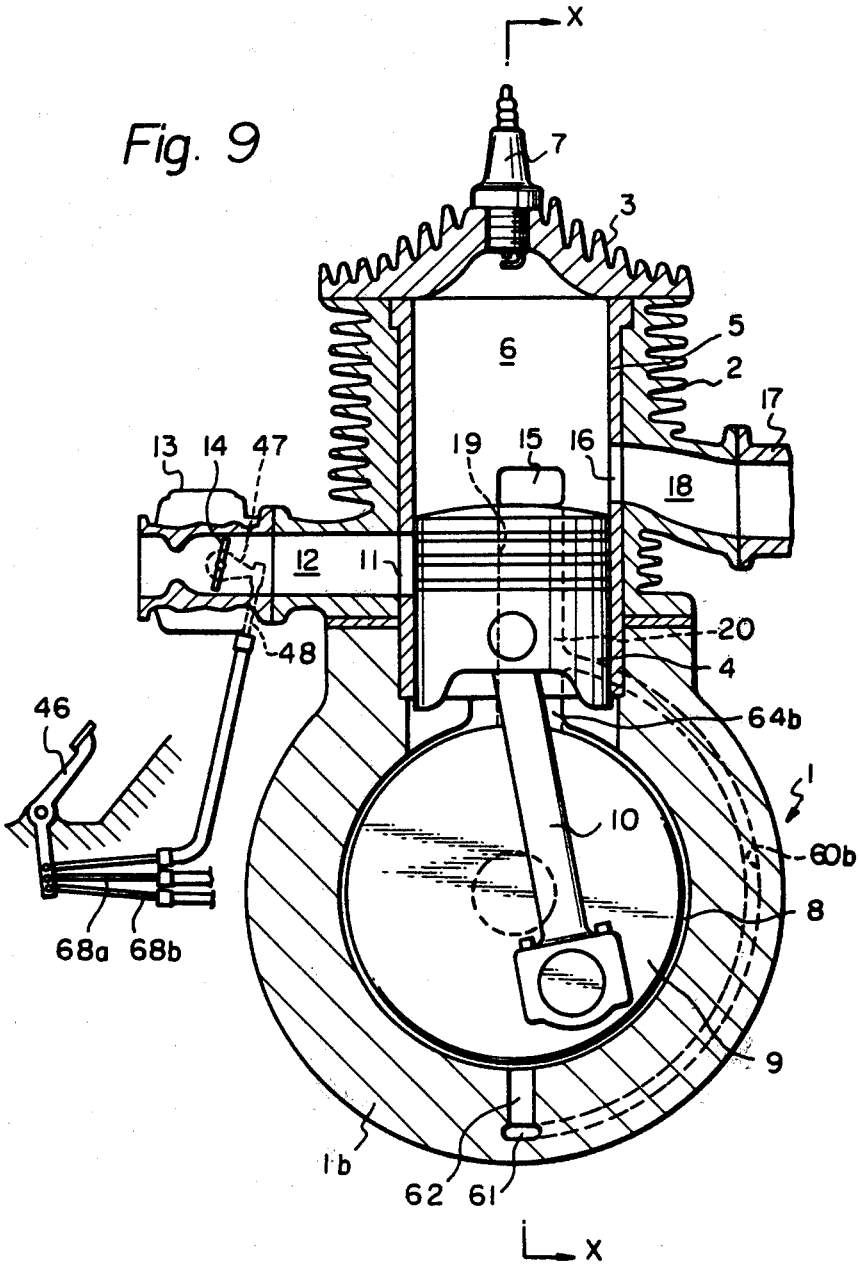
FIG. 9 is a cross-sectional side view of a further embodiment according to the present invention.
Figure 10:
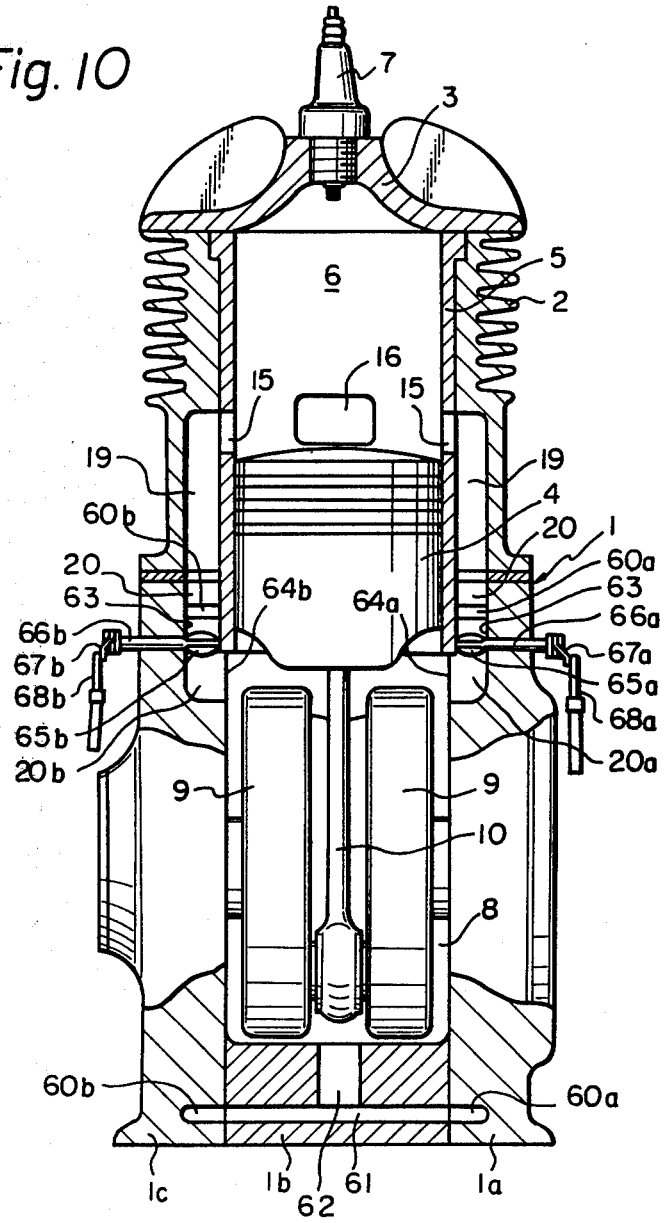
FIG. 10 is a cross-sectional side view taken along the line X—X in FIG. 9.
Figure 11:
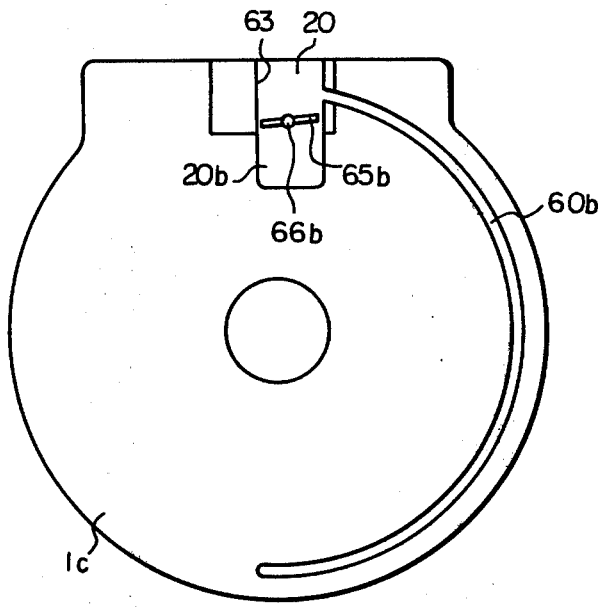
FIG. 11 is a front view of the crank case part 1*c* shown in FIG. 9.
Figure 12:
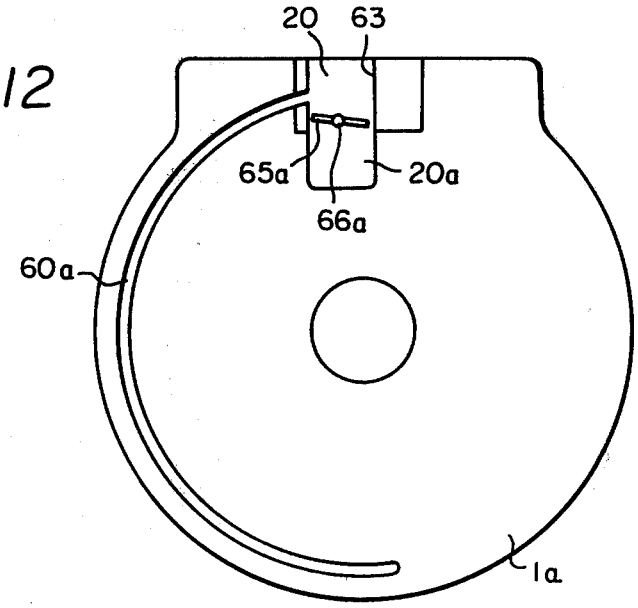
FIG. 12 is a front view of the crank case part 1*a* shown in FIG. 9.

FIG. 9 through 12 illustrate a further embodiment according to the present invention. FIG. 11 illustrates an inner wall of the crank case part 1*c*, and FIG. 12 illustrates an inner wall of the crank case part 1*a*. Referring to FIGS. 11 and 12, a single groove 60*a*, 60*b*, extending along the circular periphery of the crank case part 1*a*, 1*c*, is formed on the inner wall of the crank case part 1*a*, 1*c*. Consequently, from FIG. 10, it will be understood that, when the crank case parts 1*a*, 1*b* and 1*c* are assembled to form the crank case 1, the groove 60*a*, 60*b* forms a passage. As is illustrated in FIGS. 9 and 10, a transverse hole 61 is formed in the lower end portion of the crank case 1*b* and arranged to interconnect the lower ends of the grooves 60*a*, 60*b* to each other, which grooves are formed on the inner walls of the crank case parts 1*a* and 1*c*, respectively. This transverse hole 61 is connected to the crank room 8 via a vertical hole 62 which is formed on the bottom wall of the crank room 8. As is illustrated in FIGS. 11 and 12, a groove 63, defining the transfer passage 20 and having a depth which is approximately equal to that of the groove 60*a*, 60*b*, is formed on the upper end portion of the inner wall of the crank case part 1*a*, 1*c*, and each of the grooves 60*a*, 60*b* opens into the upper interior of the groove 63. In addition, as is illustrated in FIG. 10, the lower ends 20*a* and 20*b* of the transfer passages 20 open into the upper interior of the crank room 8 at openings 64*a* and 64*b*, respectively, and butterfly valves 65*a* and 65*b* are arranged in the transfer passages 20 between the openings 64*a* and 64*b* and upper open ends of the grooves 60*a* and 60*b*, respectively. Arms 67*a* and 67*b* are fixed onto the outer ends of valve shafts 66*a* and 66*b* of the butterfly valves 65*a* and 65*b*, respectively, and the tips of the arms 67*a* and 67*b* are connected to the accelerator pedal 46 via wires 68*a* and 68*b*, respectively, so that, when the opening degree of the throttle valve 14 is small and, thus, the engine is operating under a light load, the butterfly valves 65*a*, 65*b* remain fully closed, while the butterfly valves 65*a*, 65*b* remain fully opened when the opening degree of the throttle valve 65*a*, 65*b* becomes approximately 75 percent relative to the full open degree. Consequently, when the engine is operating under a partial load and, thus, the butterfly valves 65*a*, 65*b* remain fully closed, the fresh combustible mixture in the crank room 8 is fed into the transfer passages 20 via the vertical hole, 62, the transverse hole 61 and the grooves 60*a*, 60*b*. On the other hand, when the engine is operating under a heavy load and, thus, the butterfly valves 65*a*, 65*b* remain fully opened, the fresh combustible mixture in the crank room 8 is directly fed into the transfer passages 20 via the openings 64*a*, 64*b*. That is, the lower ends 20*a*, 20*b* of the transfer passages 20 form bypass passages used for feeding the fresh combustible mixture into the transfer passages 20 from the crank room 8 without passing through the grooves 60*a*, 60*b*.

As is mentioned above, when the engine is operating under a partial load, the fresh combustible mixture in the crank room 8 is fed into the transfer passages 20 via the grooves 60*a*, 60*b*. As will be understood from FIGS. 9 and 10, since the cross-sectional area of the grooves 60*a*, 60*b* is extremely small and, in addition, only a single groove 60*a* 60*b* is provided for the respective transfer passage 20, the fresh combustible mixture flows at a high speed in the groove 60*a*, 60*b* and, as a result, the vaporization of the liquid fuel is promoted in the grooves 60*a*, 60*b*. After this, when the fresh combustible mixture flows into the transfer passages 20, the stream of the fresh combustible mixture is decelerated as in the engine illustrated in FIG. 1. Then, the fresh combustible mixture flows into the combustion chamber 6 at a low speed. As a result of this, the self-ignition of the fresh combustible mixture, which is not caused by the spark plug 7, is caused and, thus, the active thermoatmosphere combustion is carried out.

On the other hand, when the engine is operating under a heavy load, the butterfly valves 65*a*, 65*b* remain fully opened. As a result of this, the fresh combustible mixture in the crank room 8 is fed into the transfer passages 20 via the openings 64*a*, 64*b* and, thus, the fresh combustible mixture is ignited by the spark plug 7 as in a conventional 2-cycle engine.

According to the present invention, when an engine is operating under a partial load, the active thermoatmosphere combustion is carried out. On the other hand, when an engine is operating under a heavy load, since the fresh combustible mixture is fed into the combustion chamber via a short transfer passage having a large cross-sectional area, it is possible to feed a large amount of the fresh combustible mixture into the combustible chamber and, thus, a high output torque can be obtained when an engine is operating under a heavy load. In addition, even when an engine is operating under a heavy load, since the vaporization of the liquid fuel is promoted and, in addition, the dissipation of the heat is reduced as compared with that in a conventional 2-cycle engine, fuel consumption can be improved and, at the same time, the amount of harmful components in the exhaust gas can be reduced.

While the invention has been described by reference to specific embodiments chosen for purposes of illustration, it should be apparent that numerous modifications could be made thereto by those skilled in the art without departing from the spirit and scope of the invention.

What is claimed is:

1. A 2-cycle engine comprising:

an engine body having therein a cylinder bore and a crank room which has a bottom wall;

an piston reciprocally movable in said cylinder bore, said piston and said cylinder bore defining a combustion chamber;

an intake passage having mixture forming means therein for introducing a fresh combustible mixture into said crank room;

an exhaust passage having an exhaust port opening into said combustion chamber for discharging exhaust gas into the atmosphere;

first transfer passage means having an inlet opening which opens into said crank room;

second transfer passage means communicating said first transfer passage means with an inlet port opening into said combustion chamber, said second transfer passage means having a cross-sectional area which is larger that of said first transfer passage means;

bypass passage means communicating said second transfer passage means with said crank room;

normally closed valve means arranged in said bypass passage means and actuated in response to changes in the level of the load of the engine for opening said valve means when the load of the engine is increased beyond a predetermined level, and;

ignition means arranged in said combustion chamber.

2. A 2-cycle engine as claimed in claim 1, wherein the length of said first transfer passage means is longer than that of said second transfer passage means.

3. A 2-cycle engine as claimed in claim 1, wherein said second transfer passage means comprises at least one second transfer passage, said first transfer passage means comprising at least one first transfer passage.

4. A 2-cycle engine as claimed in claim 1, wherein said second transfer passage means comprises a pair of second transfer passages and said first transfer passage means comprising a pair of first transfer passages, each being connected to the respective second transfer passages.

5. A 2-cycle engine as claimed in claim 4, wherein said second transfer passage has an approximately uniform cross-sectional area over the entire length thereof.

6. A 2-cycle engine as claimed in claim 4, wherein said second transfer passage comprises a first portion connected to said combustion chamber, and a second portion connected to said first transfer passage and having a cross-sectional area which is smaller than that of said first portion.

7. A 2-cycle engine as claimed in claim 6, wherein said second portion comprises a pair of branches opening into said second transfer passage so as to oppose to each other, said branches being connected to the common first transfer passage.

8. A 2-cycle engine as claimed in claim 4, wherein said first transfer passage opens into said second transfer passage at a right angle relative to a longitudinal axis of said second transfer passage.

9. A 2-cycle engine as claimed in claim 4, wherein said pair of the first transfer passages is connected to the common bypass passage means.

10. A 2-cycle engine as claimed in claim 1, wherein the inlet opening of said first transfer passage means is formed on the bottom wall of said crank room.

11. A 2-cycle engine as claimed in claim 1, wherein said bypass passage means comprises a single bypass passage arranged beneath said crank room and said valve means comprises a single valve arranged in said bypass passage.

12. A 2-cycle engine as claimed in claim 11, wherein said bypass passage is connected to said crank room via the inlet opening of said first transfer passage means.

13. A 2-cycle engine as claimed in claim 1, wherein said bypass passage means is arranged at an upper end of said crank room.

14. A 2-cycle engine as claimed in claim 13, wherein said bypass means comprises a pair of bypass passages and said valve means comprises a pair of valves each being arranged in the respective bypass passages.

15. A 2-cycle engine as claimed in claim 1, wherein said bypass passage means has a cross-sectional area which is approximately equal to that of said second transfer passage means.

16. A 2-cycle engine as claimed in claim 15, wherein said second transfer passage means has an approximately uniform cross-section over the entire length thereof.

17. A 2-cycle engine as claimed in claim 15, wherein said second transfer passage means comprises a first passage portion connected to said combustion chamber, and a second passage portion connected to said first transfer passage means and having a cross-sectional area which is smaller than that of said first passage portion, said bypass passage means having a cross-sectional area which is approximately equal to that of said second passage portion.

18. A 2-cycle engine as claimed in claim 1, wherein said valve means comprises a valve device and a valve actuating device for opening said valve device when the load of the engine is increased beyond the predetermined level.

19. A 2-cycle engine as claimed in claim 18, wherein said valve device comprises a rotary valve.

20. A 2-cycle engine as claimed in claim 18, wherein said valve device comprises a butterfly valve.

21. A 2-cycle engine as claimed in claim 18, wherein said valve actuating device comprises an acceleration pedal.

22. A 2-cycle engine as claimed in claim 18, wherein said valve actuating device comprises a vacuum operated diaphragm apparatus having a vacuum chamber which is connected to said intake passage. pg,26

23. A 2-cycle engine as claimed in claim 22, wherein said mixture forming means forms a venturi therein, said vacuum chamber being connected to said venturi for opening said valve device when the amount of air introduced into said crank room from the atmosphere is increased beyond a predetermined value

* * * * *

UNITED STATES PATENT AND TRADEMARK OFFICE

CERTIFICATE OF CORRECTION

PATENT NO. : 4,204,488

DATED : May 27, 1980

INVENTOR(S) : Sigeru ONISHI

It is certified that error appears in the above-identified patent and that said Letters Patent are hereby corrected as shown below:

Column 12, line 7, cancel "pg,26".

Signed and Sealed this

*Twenty-second* Day of *July 1980*

[SEAL]

*Attest:*

SIDNEY A. DIAMOND

*Attesting Officer*

*Commissioner of Patents and Trademarks*